US011305961B2

(12) United States Patent
Jennings et al.

(10) Patent No.: US 11,305,961 B2
(45) Date of Patent: Apr. 19, 2022

(54) MANDREL FOR HOLDING AND ALIGNING FILM SUPPLY ROLLS

(71) Applicant: Sealed Air Corporation (US), Charlotte, NC (US)

(72) Inventors: Robert D. Jennings, York, SC (US); Andrew T. Wood, Charlotte, NC (US)

(73) Assignee: Sealed Air Corporation (US), Charlotte, NC (US)

( * ) Notice: Subject to any disclaimer, the term of this patent is extended or adjusted under 35 U.S.C. 154(b) by 0 days.

(21) Appl. No.: 17/263,940

(22) PCT Filed: Jul. 16, 2019

(86) PCT No.: PCT/US2019/041954

§ 371 (c)(1),
(2) Date: Jan. 28, 2021

(87) PCT Pub. No.: WO2020/028032

PCT Pub. Date: Feb. 6, 2020

(65) Prior Publication Data

US 2021/0261380 A1 Aug. 26, 2021

Related U.S. Application Data

(60) Provisional application No. 62/711,646, filed on Jul. 30, 2018.

(51) Int. Cl.
*B65H 75/24* (2006.01)

(52) U.S. Cl.
CPC ... *B65H 75/242* (2013.01); *B65H 2301/4132* (2013.01); *B65H 2301/41828* (2013.01); *B65H 2701/1752* (2013.01)

(58) Field of Classification Search
CPC ..... B65H 75/242; B65H 2301/4132; B65H 2301/41828
See application file for complete search history.

(56) References Cited

U.S. PATENT DOCUMENTS 3,142,599 A 7/1964 Chavannes
3,208,898 A 9/1965 Chavannes et al.
(Continued)

FOREIGN PATENT DOCUMENTS

CN 202864536 U 4/2013
EP 1634703 A2 3/2006
(Continued)

OTHER PUBLICATIONS

PARA Company LLC Side Adjustable Air Shaft, downloaded from http://para-company.com/wp-content/uploads/2017/01/Lat-Adjust-Brochure.pdf in Jun. 2018.
(Continued)

*Primary Examiner* — Sang K Kim
(74) *Attorney, Agent, or Firm* — Jon M. Isaacson

(57) ABSTRACT

A mandrel includes a shaft that can hold a supply roll of film. A primary button and one or more secondary buttons are located on the shaft. The primary button and the one or more secondary buttons are biased toward an extended position and are capable of moving to a retracted position. The primary button and the one or more secondary buttons retract to the retracted position during at least a portion of loading the supply roll of film onto the shaft. The retraction of the primary button to the retracted position causes retraction of the one or more secondary buttons to the retracted position. When the supply roll of film is in an aligned position on the shaft, the supply roll of film is maintained in the aligned position in part by one of the primary button and the one or more secondary buttons in the extended position.

20 Claims, 9 Drawing Sheets

(56) References Cited

U.S. PATENT DOCUMENTS

| | | | | |
|---|---|---|---|---|
| 3,285,793 | A | 11/1966 | Chavannes | |
| 3,508,992 | A | 4/1970 | Chavannes | |
| 3,586,565 | A | 6/1971 | Fielding | |
| 3,616,155 | A | 10/1971 | Chavannes | |
| 3,660,189 | A | 5/1972 | Troy | |
| 3,799,465 | A * | 3/1974 | Erny | B65H 75/08 242/597.3 |
| 4,003,525 | A | 1/1977 | Podvin et al. | |
| 4,181,548 | A | 1/1980 | Weingarten | |
| 4,184,904 | A | 1/1980 | Gaffney | |
| 4,415,398 | A | 11/1983 | Ottaviano | |
| 4,576,669 | A | 3/1986 | Caputo | |
| 4,579,516 | A | 4/1986 | Caputo | |
| 4,917,013 | A | 4/1990 | Katz | |
| 5,927,635 | A | 7/1999 | Black et al. | |
| 6,155,517 | A * | 12/2000 | Lippold | B65H 75/242 242/571.5 |
| 6,800,162 | B2 | 10/2004 | Kannankeril et al. | |
| 6,982,113 | B2 | 1/2006 | Kannankeril et al. | |
| 7,018,495 | B2 | 3/2006 | Kannankeril et al. | |
| 7,165,375 | B2 | 1/2007 | O'Dowd | |
| 7,220,476 | B2 | 5/2007 | Sperry et al. | |
| 7,223,461 | B2 | 5/2007 | Kannankeril et al. | |
| 7,429,304 | B2 | 9/2008 | McNamara et al. | |
| 7,721,781 | B2 | 5/2010 | Sperry et al. | |
| 7,922,473 | B2 | 4/2011 | Gelli et al. | |
| 7,950,433 | B2 | 5/2011 | Sperry et al. | |
| 2005/0258301 | A1 * | 11/2005 | Hirte | B65H 75/242 242/597.6 |
| 2010/0200169 | A1 | 8/2010 | Sperry et al. | |
| 2014/0029956 | A1 | 1/2014 | Le Taillandier De Gabory et al. | |
| 2014/0314978 | A1 | 10/2014 | Lepine et al. | |
| 2015/0075114 | A1 | 3/2015 | Murch et al. | |
| 2016/0064277 | A1 | 3/2016 | Park et al. | |

FOREIGN PATENT DOCUMENTS

| | | | |
|---|---|---|---|
| EP | 3293123 | A1 | 3/2018 |
| GB | 1329529 | A | 9/1973 |
| SU | 59457 | A1 | 11/1940 |
| SU | 166279 | A | 1/1965 |
| WO | 199720695 | A1 | 6/1997 |

OTHER PUBLICATIONS

PARA Company LLC Latera Adjust Film Spindle Air Shaft, downloaded from http://para-company.com/wp-content/uploads/2017/01/Film-Spindle.pdf in Jun. 2018.

Written Opinion of the International searching authority in PCT/US2019/041954 dated Feb. 6, 2020.

* cited by examiner

MANDREL FOR HOLDING AND ALIGNING FILM SUPPLY ROLLS

BACKGROUND

The present disclosure is in the technical field of film supply roll mandrels. More particularly, the present disclosure is directed to a mandrel that can be oriented horizontally and allow for film supply rolls to be loaded manually and automatically align the film supply rolls without the use of tools.

Mandrels are used to hold supply rolls of film in machines that use the film. In many instances, it may be desirable to align a supply roll with one end of a mandrel. This alignment may allow for the film to pass properly through the machine along a particular path of travel. Previous alignment systems for mandrels may not be appropriate for particular solutions. In one example, some systems align supply rolls using an inclined mandrel that allows gravity to act on the supply roll causing the supply roll to align with the lower end of the mandrel. However, inclined mandrels are not horizontal and it may be desirable for a supply roll to be horizontal. In another example, a sensor may be used to detect the position of film on the path of travel from the supply roll and the position of the supply roll on the mandrel may be automatically adjusted based on feedback from the sensor to properly align the supply roll. However, these automatic adjustment systems can be complex and require a number of powered components (e.g., the sensor, a motor to move the supply roll, a controller to control the motor based on the sensor feedback, etc.). In another example, some systems allow a user to manually adjust and/or lock a supply roll in a particular location using tools (e.g., chucks, adjustable collars, etc.). However, these manual systems require a user to have the proper tool available during proper alignment and these manual systems are prone to human error that can result in improper alignment.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In one embodiment, a mandrel includes a shaft, a primary button, and one or more secondary buttons. The shaft is configured to hold a supply roll of film. The primary button and the one or more secondary buttons are located on the shaft. The primary button and the one or more secondary buttons are biased toward an extended position and are capable of moving to a retracted position. The primary button and the one or more secondary buttons are arranged on the shaft such that the primary button and the one or more secondary buttons retract to the retracted position during at least a portion of loading the supply roll of film onto the shaft. Retraction of the primary button to the retracted position causes retraction of the one or more secondary buttons to the retracted position. When the supply roll of film is in an aligned position on the shaft, the supply roll of film is maintained in the aligned position in part by one of the primary button and the one or more secondary buttons in the extended position.

In one example, the primary button and the one or more secondary buttons are arranged on the shaft such that retraction of the one or more secondary buttons to the retracted position does not cause retraction of the primary button or any other of the one or more secondary buttons to the retracted position. In another example, the primary button and the one or more secondary buttons are arranged on the shaft such that extension of any one of the primary button or the one or more secondary buttons to the extended position does not cause extension of any other one of the primary button or the one or more secondary buttons to the extended position.

In another example, the supply roll of film has a width that is one of a number of possible different widths. In another example, the number of possible different widths is one more than the number of the one or more secondary buttons. In another example, the one or more secondary buttons includes a plurality of secondary buttons. In another example, the primary button and the plurality of secondary buttons are arranged axially along the shaft.

In another example, the primary button and the one or more secondary buttons are arranged on the shaft such unloading of the supply roll of film can be accomplished by applying a force to the primary button to retract the primary button and the one or more secondary buttons to the retracted position and sliding the supply roll of film off of the shaft while the primary button and the one or more secondary buttons are in the retracted position. In another example, the shaft has a proximal end and a distal end, and wherein the loading of the supply roll of film onto the shaft is accomplished by sliding a core of the supply roll of film over the distal end of the mandrel and further sliding the supply roll of film toward the proximal end of the shaft. In another example, the mandrel further includes a collar coupled to the proximal end of the shaft. In another example, when the supply roll of film is in the aligned position on the shaft, the supply roll of film is between the collar and the one of the primary button and the one or more secondary buttons in the extended position. In another example, the mandrel further includes an end cap positioned on the distal end of the shaft and the end cap is arranged to permit the supply roll of film to be slid onto the distal end of the shaft.

In another example, the mandrel further includes a retraction and extension system configured to engage the primary button and to the one or more secondary buttons to cause the one or more secondary buttons to retract to the retracted position in response to the primary button being retracted to the retracted position. In another example, each of the primary button and the one or more secondary buttons is rotatable about a biased pivot point and is biased to the extended position by the biased pivot point. In another example, the retraction and extension system includes a slider configured to translate axially in a limited range inside of the shaft and a plurality of pins fixedly coupled to the slider. In another example, rotation of the primary button as the primary button is retracted from the extended position to the retracted position causes the primary button to exert a force on a first pin of the plurality of pins resulting in axial translation of the slider. In another example, the axial translation of the slider causes one or more second pins of the plurality of pins to exert a force on the one or more secondary buttons resulting in the one or more secondary buttons retracting from the extended position to the retracted position.

In another embodiment, a method can be performed to load a supply roll of film onto a mandrel that is capable of holding supply rolls of different widths. The method includes aligning the supply roll of film with a distal end of a shaft of the mandrel, where a width of the supply roll has is one of the different widths. The method further includes sliding the supply roll of film onto the shaft over the distal end of the shaft until the supply roll of film contacts a primary button on the shaft and retracts the primary button from an extended position to a retracted position, where mandrel is configured such that retraction of the primary button to the retracted position causes one or more secondary buttons on the shaft to be retracted from an extended position to a retracted position. The method further includes further sliding the supply roll of film along the shaft until the supply roll of film reaches an aligned position on the shaft. When the supply roll of film is in the aligned position, the supply roll of film is not in contact with the primary button, the primary button is in the extended position, and the supply roll of film is maintained in the aligned position in part by one of the primary button and the one or more secondary buttons in the extended position.

In one example, the primary button and the one or more secondary buttons are arranged axially along the shaft and the primary button is closer to the distal end than the one or more secondary buttons. In another example, the method further includes manually depressing the primary button while the supply roll of film is in the aligned position to cause the primary button to move from the extended position to the retracted position, where the mandrel is configured such that movement of the primary button to the retracted position caused by the manually depressing causes any of the one or more secondary buttons in the extended position to retract to the retracted position. In another example, the method further includes removing the supply roll of film from the shaft of the mandrel, where at least a portion of the removing occurs during a portion of the manually depressing of the primary button, and wherein the removing includes sliding the supply roll of film from the aligned position while the primary button is being manually depressed.

BRIEF DESCRIPTION OF THE DRAWING

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

The present disclosure describes embodiments of mandrels that are capable of holding supply rolls of different widths. In some embodiments, a mandrel can be loaded by aligning a supply roll of film with a distal end of a shaft of the mandrel. The width of the supply roll has is one of a number of different widths of supply rolls that can be held by the mandrel. The supply roll of film is the slid onto the shaft over the distal end of the shaft until the supply roll of film contacts a primary button on the shaft and retracts the primary button from an extended position to a retracted position. The mandrel is configured such that retraction of the primary button to the retracted position causes one or more secondary buttons on the shaft to be retracted from an extended position to a retracted position. The supply roll is further slide along the shaft until the supply roll of reaches an aligned position on the shaft. When the supply roll of film is in the aligned position the supply roll of film is not in contact with the primary button, the primary button is in the extended position, and the supply roll of film is maintained in the aligned position in part by one of the primary button and the one or more secondary buttons in the extended position. When the supply roll is manually loaded onto the mandrel, the button that maintains the supply roll of film in the aligned position automatically locks the supply roll into place without a user needing to otherwise manipulate the supply roll or the mandrel.

In some embodiments discussed herein the supply roll can be removed from the mandrels manually by depressing the primary button while the supply roll of film is in the aligned position. This causes the primary button to retract, which results in the one or more secondary buttons retracting. With all of the primary button and the one or more secondary buttons retracted, the supply roll can be moved from the aligned position and the fully removed from the shaft of the mandrel.

Figure 1:
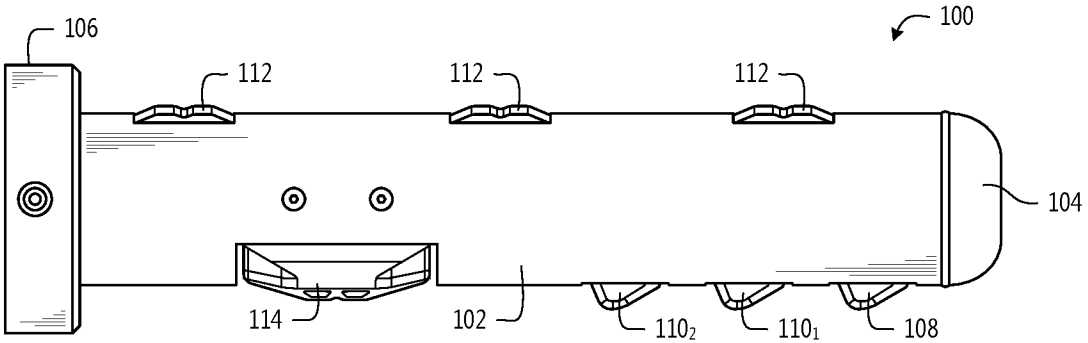
FIG. 1 depicts an embodiment of a mandrel that is capable of holding supply rolls of different widths and aligning the supply rolls regardless of their widths, in accordance with the embodiments disclosed herein.

Depicted in FIG. 1 is an embodiment of a mandrel 100 that is capable of holding supply rolls of different widths and aligning the supply rolls regardless of their widths. The mandrel 100 includes a shaft 102. The mandrel 100 also includes an end cap 104 on a distal end of the shaft 102 and a collar 106 on the proximal end of the shaft 102. In the depicted embodiment, the end cap 104 is arranged to permit a supply roll to be slid onto the shaft 102 from the distal end of the shaft 102 toward the proximal end of the shaft 102 until the supply roll reaches the collar 106. In the depicted embodiment, the collar 106 serves as a stop that prevents the supply roll from being slid along the shaft 102 beyond the collar 106.

The mandrel 100 includes a primary button 108 that is located near the distal end of the shaft 102. The mandrel 100 also includes a secondary button $\mathbf{110}_1$ and a secondary button $\mathbf{110}_2$ (collectively secondary buttons 110) that are located progressively closer to the proximal end of the shaft 102 from the primary button 108. In the depicted embodiment, the number of secondary buttons 110 is two (i.e., the secondary button $\mathbf{110}_1$ and the secondary button $\mathbf{110}_2$); however, in other embodiments, the number of secondary buttons 110 could include any number (i.e., one or more) of secondary buttons. In the depicted embodiment, the primary button 108 and the secondary buttons 110 are arranged axially along the shaft 102. Each of the primary button 108 and the secondary buttons 110 is biased toward an extended position. In the depicted embodiment, each of the primary button 108 and the secondary buttons 110 is in the extended position. Each of the primary button 108 and the secondary buttons 110 can be depressed to a retracted position. In some embodiments, retraction of the primary button 108 causes retraction of the secondary buttons 110, retraction of one of the secondary buttons 110 does not cause retraction of the primary button or any other of the secondary buttons, and extension of any one of the primary button 108 and the secondary buttons 110 does not cause extension of any other of the primary button 108 and the secondary buttons 110. These relationships are discussed in greater detail below.

In the depicted embodiment, the shaft 102 also includes friction mechanisms 112 that are configured to engage the core of a supply roll. In the depicted embodiment, the friction mechanisms 112 are spring-loaded tabs that are located on an opposite side of the shaft 102 from the primary button 108 and the secondary buttons 110. In some embodiments, the friction mechanisms 112 are arranged to exert a force on the core of the supply roll away from the shaft 102 and away from the primary button 108 and the secondary buttons 110. In the depicted embodiment, the shaft 102 also includes a tension brake 114 configured to engage the core of the supply roll. The tension brake 114 may exert a force on the core of the supply roll as the film is being withdrawn from the core to induce an amount of tension in the withdrawn film. In the depicted embodiment, the tension brake 114 is a spring-loaded tension brake.

Figure 2:
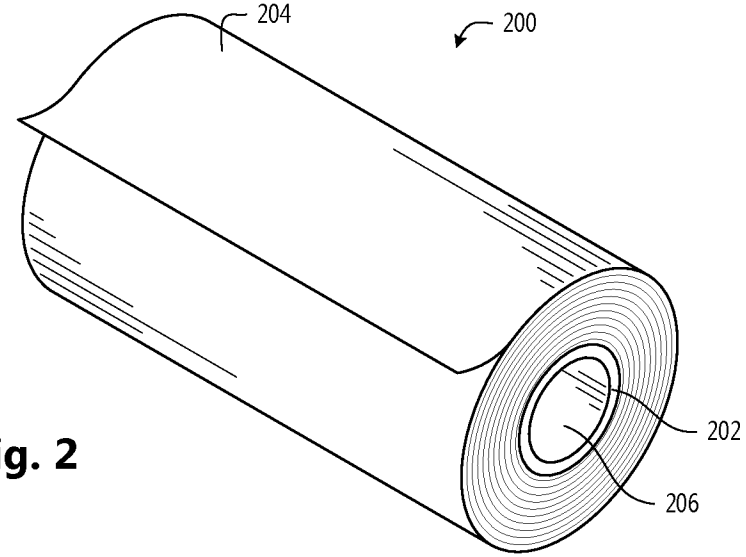
FIG. 2 depicts an embodiment of a supply roll that can be loaded onto the mandrel depicted in FIG. 1, in accordance with the embodiments disclosed herein.

Depicted in FIG. 2 is an embodiment of a supply roll 200. The supply roll 200 includes a core 202. In some embodiments, the core 202 is made from a paper product (e.g., a cardboard tube, a Kraft paper tube, etc.), a plastic material, or any other material. The supply roll 200 also includes a film 204 wrapped around the core 202. In the depicted embodiment, the core 202 has a hollow bore 206. In some embodiments, a material and/or thickness of the core 202 is selected so that the core 202 does not deform from the weight of the film 204, when the core 202 is placed on a mandrel or in other uses of the core 202.

In some embodiments, the film 204 is a flexible film material that can be manipulated to enclose a fluid (e.g., air). In some embodiments, the flexible film material includes one or more of various thermoplastic materials, e.g., polyethylene homopolymer or copolymer, polypropylene homopolymer or copolymer, etc. Non-limiting examples of suitable thermoplastic polymers include polyethylene homopolymers, such as low density polyethylene (LDPE) and high density polyethylene (HDPE), and polyethylene copolymers such as, e.g., ionomers, EVA, EMA, heterogeneous (Zeigler-Natta catalyzed) ethylene/alpha-olefin copolymers, and homogeneous (metallocene, single-cite catalyzed) ethylene/alpha-olefin copolymers. Ethylene/alpha-olefin copolymers are copolymers of ethylene with one or more comonomers selected from C3 to C20 alpha-olefins, including linear low density polyethylene (LLDPE), linear medium density polyethylene (LMDPE), very low density polyethylene (VLDPE), and ultra-low density polyethylene (ULDPE). Various other polymeric materials may also be used such as, e.g., polypropylene homopolymer or polypropylene copolymer (e.g., propylene/ethylene copolymer), polyesters, polystyrenes, polyamides, polycarbonates, etc. The film may be monolayer or multilayer and can be made by any known extrusion process by melting the component polymer(s) and extruding, coextruding, or extrusion-coating them through one or more flat or annular dies.

In some embodiments, the film 204 is an inflated air cellular material in a deflated state. As used herein, the term "air cellular material" herein refers to bubble cushioning material, such as BUBBLE WRAP® air cushioning material sold by Sealed Air Corporation, where a first film or laminate is formed (e.g., thermoformed, embossed, calendared, or otherwise processed) to define a plurality of cavities and a second film or laminate is adhered to the first film or laminate in order to close the cavities. Examples of air cellular materials are shown in U.S. Pat. Nos. 3,142,599, 3,208,898, 3,285,793, 3,508,992, 3,586,565, 3,616,155, 3,660,189, 4,181,548, 4,184,904, 4,415,398, 4,576,669, 4,579,516, 6,800,162, 6,982,113, 7,018,495, 7,165,375, 7,220,476, 7,223,461, 7,429,304, 7,721,781, and 7,950,433, and U.S. Published Patent Application Nos. 2014/0314978 and 2015/0075114, the disclosures of which are hereby incorporated by reference in their entirety. In embodiments where the film 204 is an air cellular material in a deflated state, the film 204 can be unrolled and then fed through an inflation and sealing machine. The inflation and sealing machine inflates and seals cells in the air cellular material so that the air cellular material is in an inflated state. Examples of inflation and sealing machines are described in U.S. Pat. No. 7,721,781 and U.S. Published Patent Application No. 2014/0314978, the contents of which are hereby incorporated by reference in their entirety.

In many instances, it may be desirable to align a supply roll with one end of a mandrel. In some embodiments, it may be desirable to align a supply roll with a path of travel for the film to pass through an inflation and sealing machine to properly inflate and seal the cells of an air cellular material. Examples of aligning a supply roll so the film properly passes through an inflation and sealing machine are described in U.S. patent application Ser. Nos. 14/029,956 and 16/064,277, the contents of which are hereby incorporated by reference in their entirety. In some embodiments, the it may be desirable to align a supply roll with a path of travel for the film to pass through a printing mechanism capable of printing on the film. Examples of passing a film from a supply roll through a printing mechanism are described in International Application No. PCT/US2017/066564, the contents of which are hereby incorporated by reference in their entirety.

Previous alignment systems may not be appropriate for particular solutions, such as in the case where the film is fed from the supply roll through a printing mechanism. In one example, some systems align supply rolls using an inclined mandrel that allows gravity to act on the supply roll causing the supply roll to align with the lower end of the mandrel. An example of an inclined mandrel is depicted in U.S. patent application Ser. No. 14/029,956. However, inclined mandrels are not horizontal and it may be desirable for a supply roll to be horizontal when the film is fed through a printing mechanism. In another example, a sensor may be used to detect the position of film on the path of travel from the supply roll and the position of the supply roll on the mandrel may be automatically adjusted based on feedback from the sensor to properly align the supply roll. An example of a system with a film position sensor and an automatic supply roll location adjustment mechanism is depicted in U.S. patent application Ser. No. 16/064,277. However, these automatic adjustment systems can be complex and require a number of powered components (e.g., the sensor, a motor to move the supply roll, a controller to control the motor based on the sensor feedback, etc.). In another example, some systems allow a user to manually adjust and/or lock a supply roll in a particular location using tools (e.g., chucks, adjustable collars, etc.). While these manual systems allow for users to adjust the mandrel based on desired location and width of the supply roll, these manual systems require a user to have the proper tool available during proper alignment and these manual systems are prone to human error that can result in improper alignment.

The above-mentioned difficulties with prior alignment systems are addressed by the mandrel 100. More specifically, the mandrel 100 is capable of being arranged horizontally and can align supply rolls of multiple different widths automatically and passively without the need for a user to use tool to align the supply roll. An embodiment of loading the supply roll 200 on the mandrel 100 and configuring the mandrel 100 to unload the supply roll 200 is depicted in a series of instances shown in FIGS. 3A to 3G. Each of FIGS. 3A to 3G depicts a front view of the mandrel 100 and a cross-sectional view of the supply roll 200.

Figure 3A:
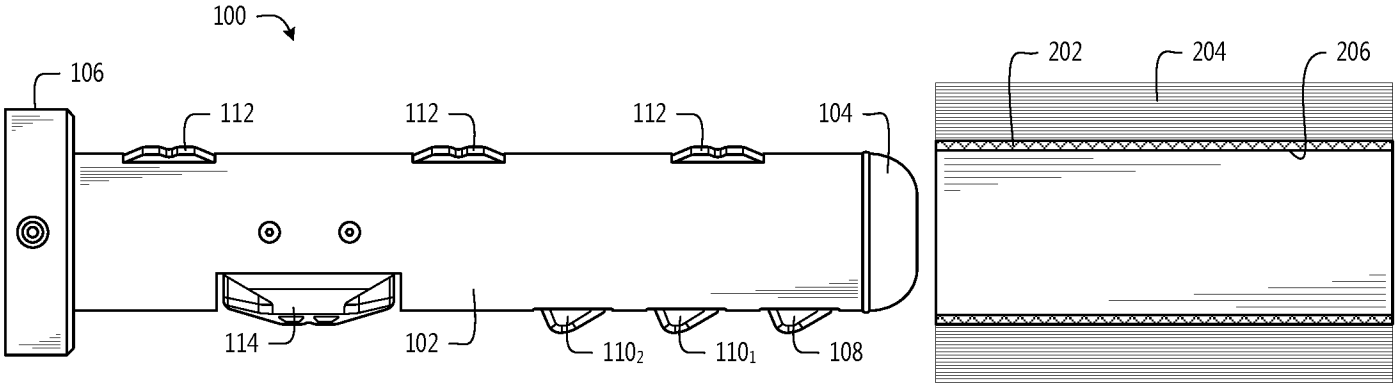
FIGS. 3A to 3G depict an embodiment of loading the supply roll depicted in FIG. 2 on the mandrel depicted in FIG. 1 from a front view of the mandrel and a cross-sectional view of the supply roll, in accordance with the embodiments disclosed herein.

In FIG. 3A, the supply roll 200 has been aligned axially with the mandrel 100. The bore 206 of the supply roll is aligned with the end cap 104 so that the bore 206 can pass over the end cap 104 as the supply roll 200 is moved axially toward the proximal end of the shaft 102 (i.e., as the supply roll is moved to the left in the depiction).

Figure 3B:
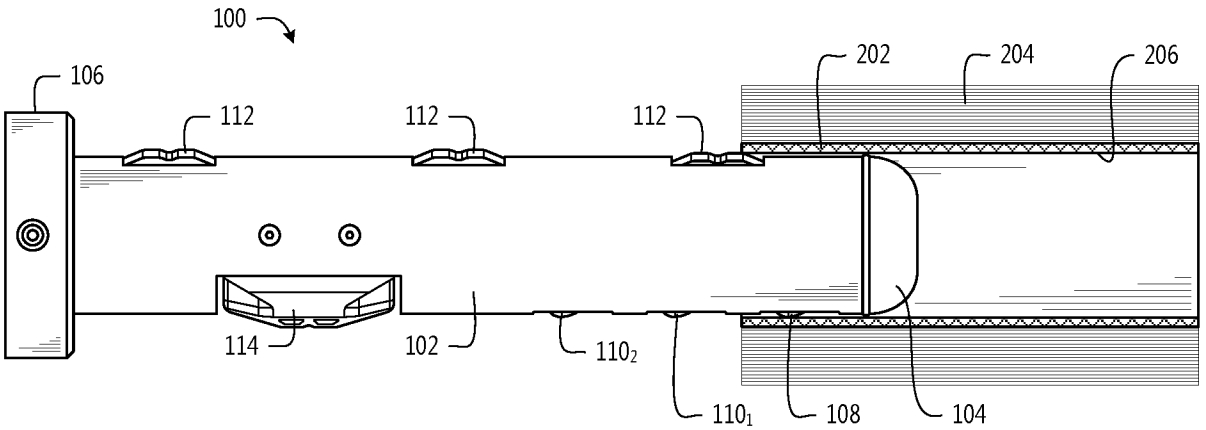

From the instance shown in FIG. 3A to the instance shown in FIG. 3B, the supply roll 200 has been moved axially toward the proximal end of the shaft 102 until the core 202 has contacted the primary button 108 and the distal-most one of the friction mechanisms 112. In some embodiments, the primary button 108 is contoured so that, as the core 202 contacts the primary button 108, the axial movement of the core 202 causes the primary button to retract from the extended position shown in FIG. 3A to the retracted position shown in FIG. 3B. In the depicted embodiment, the retraction of the primary button 108 also causes retraction of the secondary buttons 110. Because of this relationship, the retraction of the primary button 108 by the core 202 resulted in the secondary buttons 110 retracting to the retracted position shown in FIG. 3B. The core 202 has also contacted the distal-most one of the friction mechanisms 112, causing it to retract.

Figure 3C:
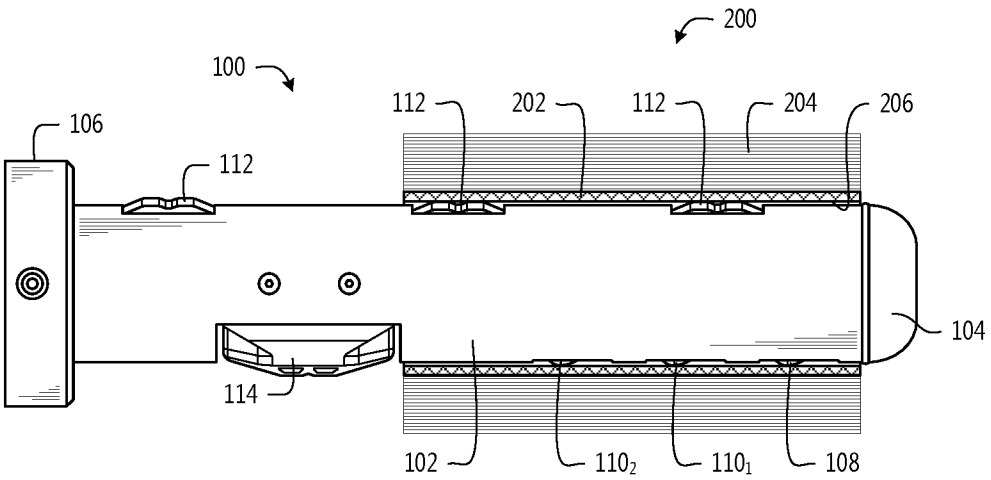

From the instance shown in FIG. 3B to the instance shown in FIG. 3C, the supply roll 200 has been moved axially further toward the proximal end of the shaft 102 until the core 202 has contacted the secondary buttons 110 and another one of the friction mechanisms 112. Because the secondary buttons 110 had already been retracted by the retraction of the primary button 108, the axial movement of the supply roll 200 between the instance shown in FIG. 3B and the instance shown in FIG. 3C did not cause the secondary buttons 110 to retract. However, the primary button 108 and the secondary buttons 110 remain in the retracted position in FIG. 3C.

Figure 3D:
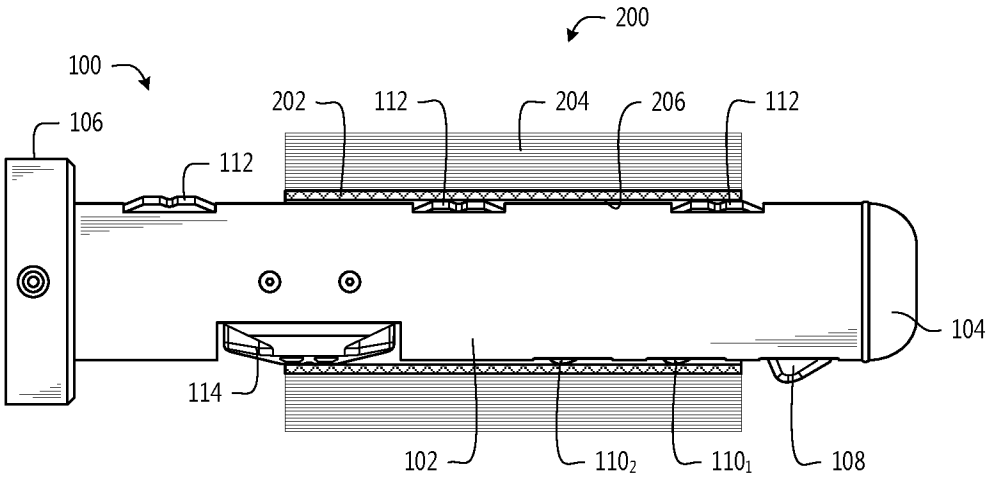

From the instance shown in FIG. 3C to the instance shown in FIG. 3D, the supply roll 200 has been moved axially further toward the proximal end of the shaft 102 until the core 202 has contacted the tension brake 114 and the core 202 is no longer in contact with the primary button 108. In the depicted embodiment, the primary button 108 is biased toward the extended position (e.g., the position shown in FIG. 3D) so that the primary button 108 extends to the extended position when the core 202 is no longer in contact with the primary button 108. In some embodiments, the extension of the primary button 108 does not cause the secondary buttons 110 to extend. The extension of the primary button 108 may permit the secondary buttons to extend. However, in the depicted embodiment, the core 202 is still in contact with the secondary buttons 110, which causes the secondary buttons 110 to remain in the retracted position. The contact of the core 202 with the tension brake 114 also causes the tension brake 114 to retract.

Figure 3E:
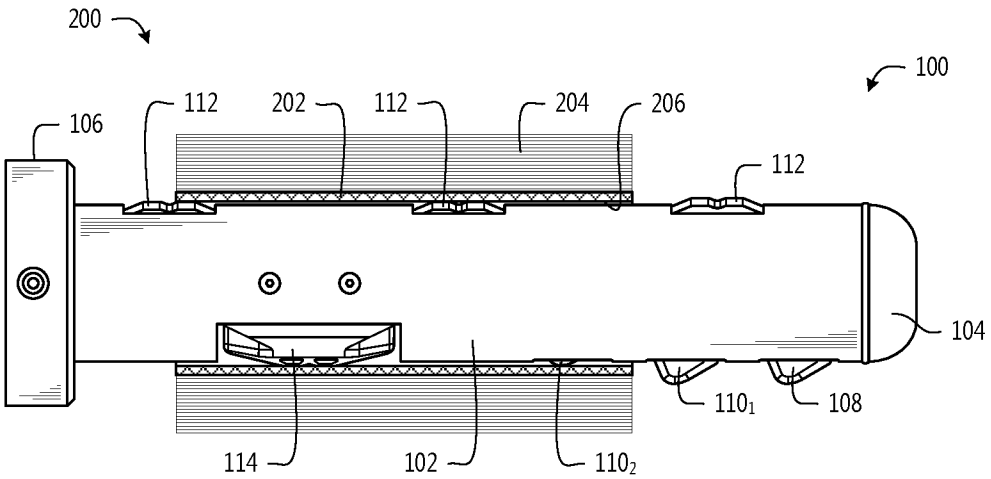

From the instance shown in FIG. 3D to the instance shown in FIG. 3E, the supply roll 200 has been moved axially further toward the proximal end of the shaft 102 until the core 202 has contacted the proximal-most one of the friction mechanisms 112 and the core 202 is no longer in contact with the secondary button $\mathbf{110}_1$ or the distal-most one of the friction mechanisms 112. In the depicted embodiment, the secondary button $\mathbf{110}_1$ is biased toward the extended position (e.g., the position shown in FIG. 3E) so that the secondary button $\mathbf{110}_1$ extends to the extended position when the core 202 is no longer in contact with the secondary button $\mathbf{110}_1$. The core 202 is still in contact with the secondary button $\mathbf{110}_2$, which causes the secondary button $\mathbf{110}_2$ to remain in the retracted position. The core 202 has also contacted the proximal-most one of the friction mechanisms 112, causing it to retract.

Figure 3F:
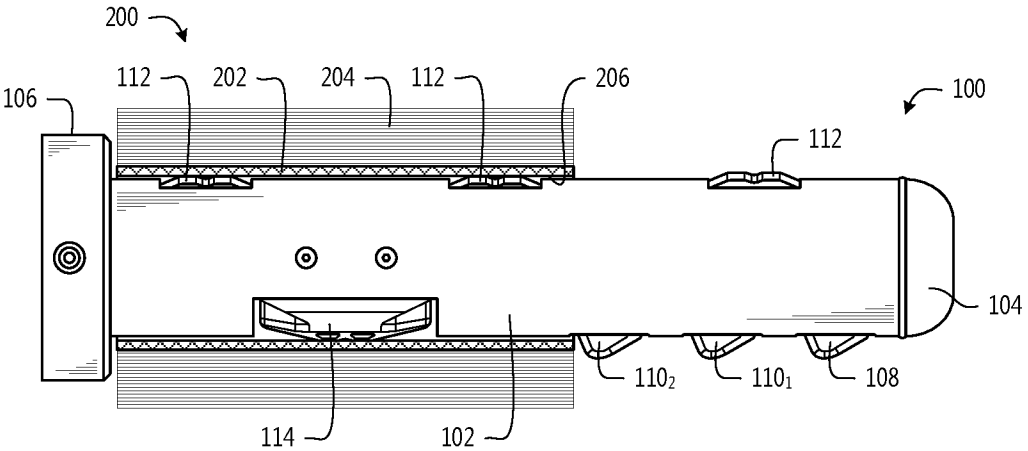

From the instance shown in FIG. 3E to the instance shown in FIG. 3F, the supply roll 200 has been moved axially further toward the proximal end of the shaft 102 until the supply roll 200 is aligned with the collar 106 at the proximal end of the mandrel 100 and the core 202 is no longer in contact with the secondary button $\mathbf{110}_2$. In the depicted embodiment, the secondary button $\mathbf{110}_2$ is biased toward the extended position (e.g., the position shown in FIG. 3F) so that the secondary button $\mathbf{110}_2$ extends to the extended position when the core 202 is no longer in contact with the secondary button $\mathbf{110}_2$. In some embodiments, the location of the secondary button $\mathbf{110}_2$ with respect to the collar 106 is selected so that the secondary button $\mathbf{110}_2$ prevents the supply roll 200 from coming out of alignment with the collar 106 while the secondary button $\mathbf{110}_2$ remains in the extended position.

While the instances shown in FIGS. 3A to 3E, depict specific instances of the movement of the supply roll 200 with respect to the mandrel 100, it will be understood that the movement of the supply roll 200 may not stop at any of the locations shown in FIG. 3A to 3E. In some embodiments, a user will continuously slide the supply roll 200 from the position shown in FIG. 3A to the position shown in FIG. 3F. Because of the actions of the primary button 108 and the secondary buttons 110, the supply roll will automatically and passively respond to the movements of the supply roll 200 such that the supply roll 200 is held in alignment, as shown in FIG. 3F, without the user needing to use any tools or make any other manual adjustments.

Figure 3G:
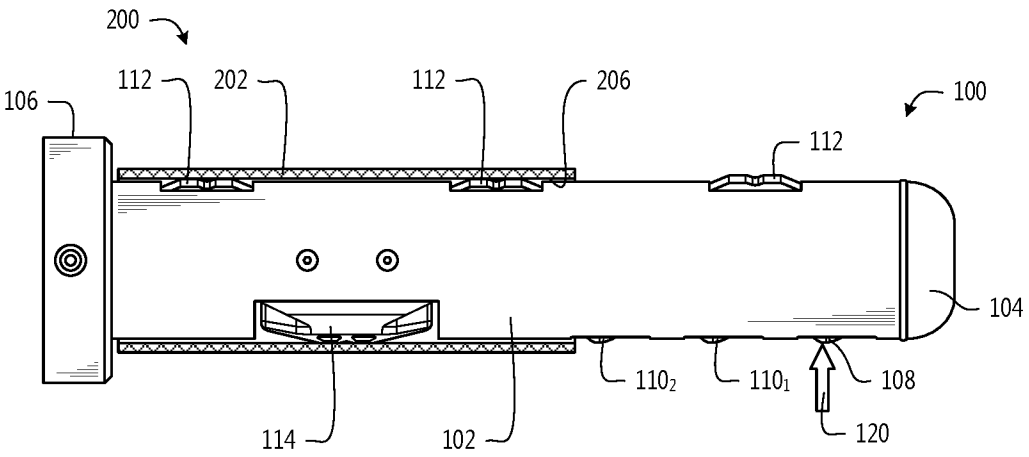

With the supply roll 200 is properly aligned in the position shown in FIG. 3F, the film 204 can be unrolled from the core 202 as the core 202 rotates around the shaft 102 of the mandrel 100. After the film 204 has been unrolled from the core 202 (sometimes referred to as after the supply roll 200 is "spent"), the core 202 remains on the shaft 102 as shown in FIG. 3G. From this position, the core 202 can be removed from the mandrel 100 so that a new supply roll can be loaded on the mandrel 100. However, the primary button 108 and the secondary buttons 110 need to be moved to the retracted positions in order to allow the core 202 to be slid off of the shaft 102 by a user. In the depicted embodiment, a force 120 is applied to the primary button 108 to cause the primary button 108 to retract. In some examples, the force 120 may be applied by a user's finger as the user manually depresses the primary button 108. The retraction of the primary button 108 due to the force 120 causes the secondary buttons 110 to retract. Thus, once the primary button 108 is depressed by the force 120, the user can slide the core 202 toward the distal end of the shaft 102 and then remove the core 202 completely from the mandrel 100.

As noted above, the mandrel is capable of accommodating supply rolls of different widths. In the depicted embodiment, the mandrel 100 has three buttons—the primary button 108, the secondary button $\mathbf{110}_1$, and the secondary button $\mathbf{110}_2$—so that the mandrel 100 is capable of holding supply rolls of three different widths. As shown in FIG. 3E, the mandrel 100 is capable of holding the supply roll 200. Depicted in FIGS. 4A and 4B are embodiments of supply rolls 210 and 220, respectively, that have different widths from each other and from the supply roll 200.

Figure 4A:
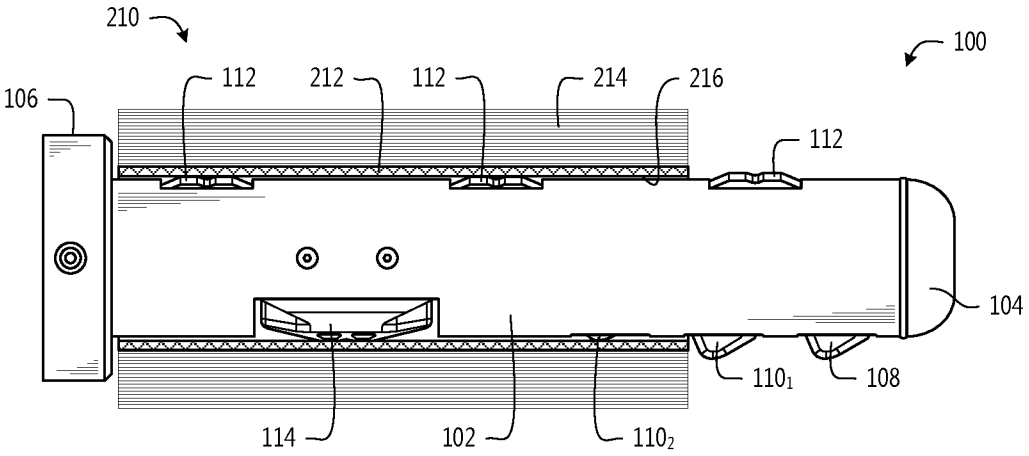
FIGS. 4A and 4B depict embodiments of supply rolls loaded on the mandrel depicted in FIG. 1, where the supply rolls in FIGS. 4A and 4B have different widths from each other and from the supply roll depicted in FIG. 2, in accordance with the embodiments disclosed herein.

FIG. 4A depicts a front view of the mandrel 100 and a cross-sectional view of the supply roll 210. The supply roll 210 includes a core 212, a film 214 wrapped around the core 212, and a hollow bore 216 in the core 212. In the depicted embodiment, the supply roll 210 is located on the shaft 102 of the mandrel 100 such that the supply roll 210 is aligned with the collar 106 of the mandrel 100 and the supply roll 210 is held in this position by the secondary button $\mathbf{110}_1$, which is in the extended position. The supply roll 210 can be moved into the position depicted in FIG. 4A in similar manner to the movements of the supply roll 200 depicted in FIGS. 3A to 3E. More specifically, the supply roll 210 can be moved axially over the end cap 104 and toward the proximal end of the shaft 102 to the position shown in FIG. 4A. This movement of the supply roll 210 will initially cause the core 212 to contact the primary button 108 to cause the primary button 108 and the secondary buttons 110 to retract. As the supply roll 210 approaches the collar 106, the core 212 will cease to be in contact with the primary button 108, allowing the primary button 108 to extend, and then cease to be in contact with the secondary button $\mathbf{110}_1$, allowing the secondary button $\mathbf{110}_1$ to extend.

Figure 4B:
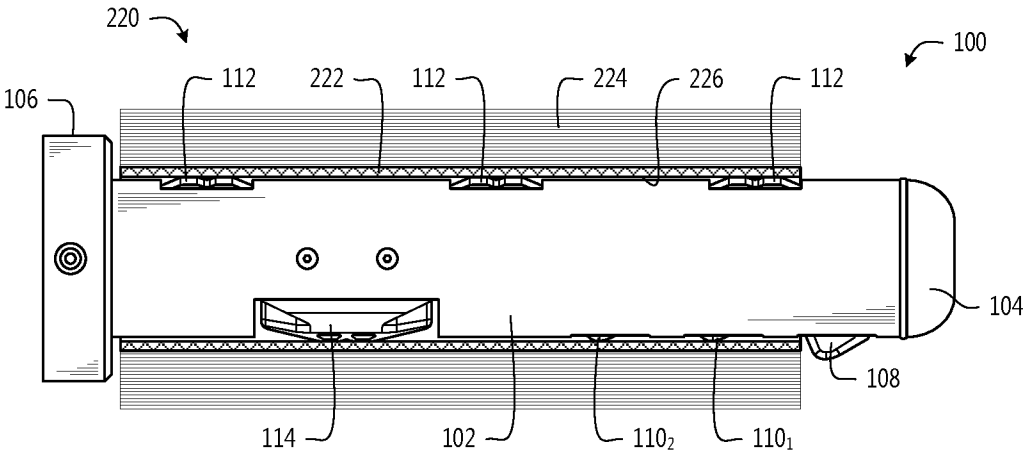

FIG. 4B depicts a front view of the mandrel 100 and a cross-sectional view of the supply roll 220. The supply roll 220 includes a core 222, a film 224 wrapped around the core 222, and a hollow bore 226 in the core 222. In the depicted embodiment, the supply roll 220 is located on the shaft 102 of the mandrel 100 such that the supply roll 220 is aligned with the collar 106 of the mandrel 100 and the supply roll 220 is held in this position by the primary button 108, which is in the extended position. The supply roll 220 can be moved into the position depicted in FIG. 4B in similar manner to the movements of the supply roll 200 depicted in FIGS. 3A to 3E. More specifically, the supply roll 220 can be moved axially over the end cap 104 and toward the proximal end of the shaft 102 to the position shown in FIG. 4B. This movement of the supply roll 210 will initially cause the core 212 to contact the primary button 108 to cause the primary button 108 and the secondary buttons 110 to retract. As the supply roll 210 approaches the collar 106, the core 212 will cease to be in contact with the primary button 108, allowing the primary button 108 to extend.

When a user is loading one of the supply rolls 200, 210, and 220 on the mandrel 100, the user does not need to make any adjustments to the mandrel 100 to accommodate the loading and/or to properly hold one of the supply rolls 200, 210, and 220. The user can simply move one of the supply rolls 200, 210, and 220 (the "selected supply roll") toward the collar 106 and, when the selected supply roll is in properly alignment with the collar 106, one of the primary button 108 and the secondary buttons 110 will hold the selected supply roll in the proper position. In some embodiments, the widths of the supply rolls 200, 210, and 220 are about 8 inches (20.3 cm), 10 inches (25.4 cm), and 12 inches (30.5 cm), respectively. When the user wants to remove the selected supply roll from the mandrel 100, the user can simply exert a force on the primary button 108 to permit the selected roll to be removed, regardless of the width of the selected supply roll. In some embodiments, the primary button 108 may be marked in some way to differentiate it from the secondary buttons 110 so that the user can identify which button to push to remove the selected supply roll. For example, the mandrel 100 can include a label to denote that the primary button 108 is used to remove supply rolls, the primary button can be a different color (e.g., green) from the color of the secondary buttons (e.g., gray), and the like.

It will be apparent that a mandrel could be configured to hold any number of widths of supply rolls. In the depicted embodiment, the mandrel 100 includes three buttons—the primary button 108, the secondary button $\mathbf{110}_1$, and the secondary button $\mathbf{110}_2$—that enables the mandrel 100 to hold three supply rolls 200, 210, and 220, each having a different width. In other embodiments, any number of secondary buttons (i.e., one or more secondary buttons) can be included on the mandrel 100. The number of supply rolls widths that can be accommodated by the mandrel 100 is one greater than the number of secondary buttons. For example, the mandrel 100 can have one secondary button so that the mandrel 100 accommodates two different widths of supply rolls, four secondary buttons to accommodate five different widths of supply rolls, or any other number of secondary buttons.

In some embodiments where a mandrel includes a primary button and one or more secondary buttons, the retraction of the primary button causes the secondary button(s) to retract and the retraction of any one of the secondary button(s) does not cause the primary button or any of the other secondary button(s). In addition, the extension of any one of the primary and secondary buttons does not cause any other of the primary and secondary buttons to extend. These retraction and extension relationships may be provided in any number of ways. Depicted in FIGS. 5A to 5F are a series of instances of how an embodiment of a retraction and extension system 300 in the mandrel 100 provides the retraction and extension relationships among the primary button 108 and the secondary buttons 110. Each of the depictions in FIGS. 5A to 5F includes a front view of a portion of the mandrel 100 and at least a portion of a cross-sectional view of the supply roll 200 as the supply roll 200 is loaded on the mandrel 100 and as the mandrel 100 is prepared for removal of the core 202.

Figure 5A:
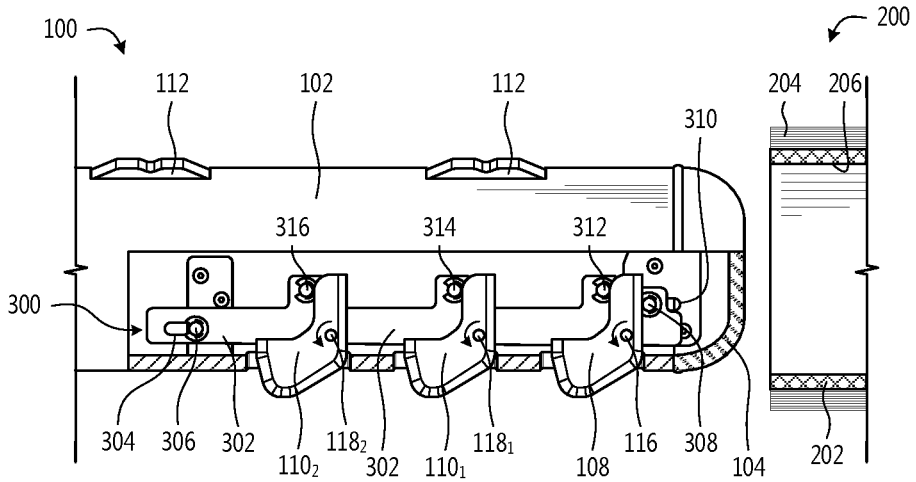
FIGS. 5A to 5F depict an embodiment retraction and extension system and a series of instances showing the relationships of the primary and secondary buttons of the mandrel shown in FIG. 1 while loading the supply roll depicted in FIG. 2, in accordance with the embodiments disclosed herein.
Figure 5B:
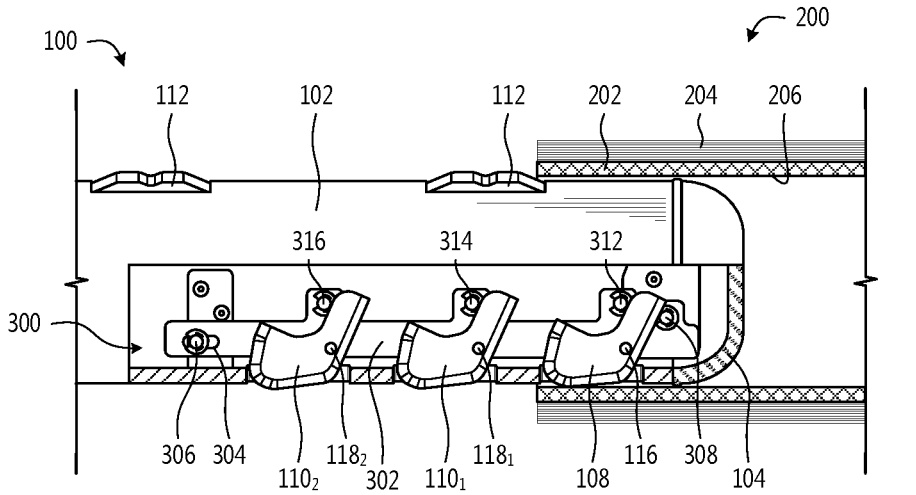
Figure 5C:
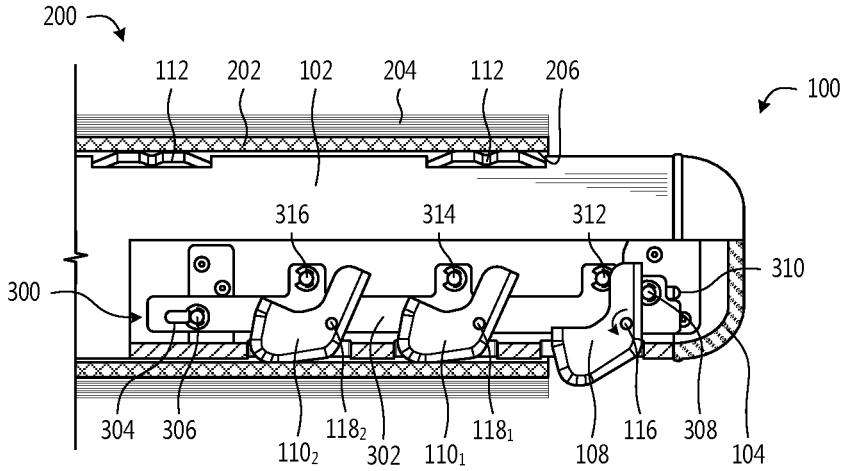
Figure 5D:
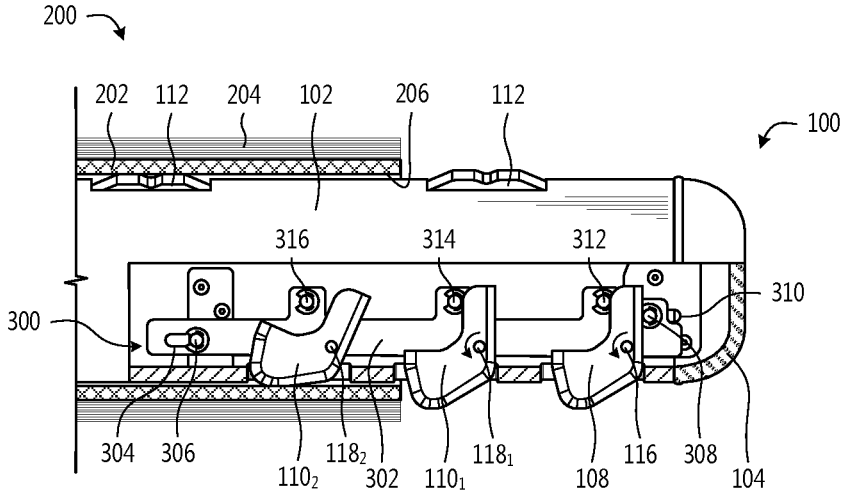
Figure 5E:
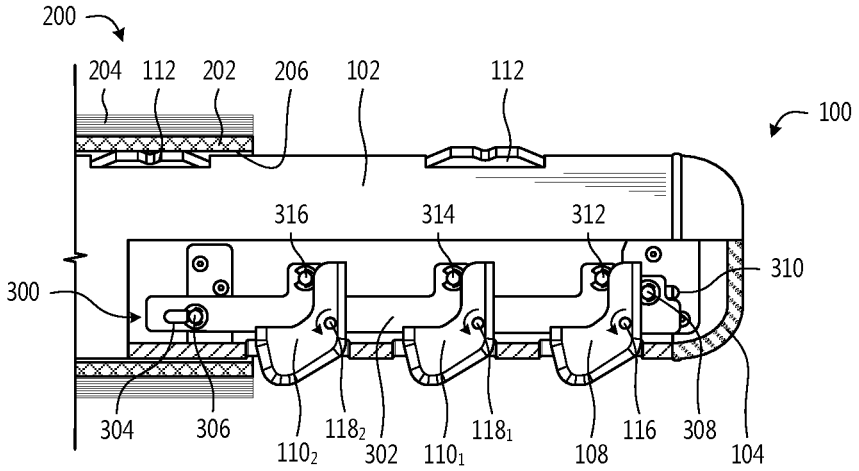

In the embodiment shown in FIGS. 5A to 5E, the primary button 108 includes a biased pivot point 116, the secondary button $\mathbf{110}_1$ includes a biased pivot point $\mathbf{118}_1$, and the secondary button $\mathbf{110}_2$ includes a biased pivot point $\mathbf{118}_2$. In the depicted embodiment, the biased pivot points 116, $\mathbf{118}_1$, and $\mathbf{118}_2$ are arranged to bias the primary button 108, the secondary button $\mathbf{110}_1$, and the secondary button $\mathbf{110}_2$ in a counterclockwise direction. In some embodiments each of the biased pivot points 116, $\mathbf{118}_1$, and $\mathbf{118}_2$ includes a torsional spring to provide a biasing force in a rotational direction. It will be noted that, in other embodiments, the primary button 108 and the secondary buttons 110 may be biased linearly by a compression spring instead of being biased rotationally as shown in FIGS. 5A and 5E.

The retraction and extension system 300 depicted in FIGS. 5A to 5E includes a slider 302. The slider 302 is configured to translate axially inside of the shaft 102. In the depicted embodiment, the slider 302 includes a slot 304 through which a pin 306 passes. The pin 306 is fixedly coupled to the shaft 102 so that the slider 302 can translate axially within the shaft 102 as far as the pin 306 permits the slot 304 to move. The slider 302 also includes a pin 308 that is fixedly coupled to the slider 302. The pin 308 passes through a slot 310 in a bracket that is fixedly coupled to the shaft 102. The slot 310 permits the slider 302 to move as far as the slot 310 permits the pin 308 to move. In the depicted embodiment, a portion of the pin 308 is located in the path of rotation of the primary button 108 in the clockwise direction above the biased pivot point 116. In the depicted embodiment, the pin 308 and the primary button 108 are arranged such that clockwise rotation of the primary button 108 will cause axial translation of the pin 308 and the slider 302 in the distal direction (i.e., to the right in the depiction) and axial translation of the slider 302 and the pin 308 in the proximal direction (i.e., to the left in the depiction) will cause counterclockwise rotation of the primary button 108.

The retraction and extension system 300 also includes pins 312, 314, and 316 that are fixedly coupled to the slider 302. A portion of the pin 312 is located in the path of rotation of the primary button 108 in the counterclockwise direction above the biased pivot point 116. In the depicted embodiment, the pin 312 and the primary button 108 are arranged such that counterclockwise rotation of the primary button 108 will cause axial translation of the pin 312 and the slider 302 in the proximal direction (i.e., to the left in the depiction) and axial translation of the slider 302 and the pin 312 in the distal direction (i.e., to the right in the depiction) will cause clockwise rotation of the primary button 108. A portion of the pin 314 is located in the path of rotation of the secondary button $\mathbf{110}_1$ in the counterclockwise direction above the biased pivot point $\mathbf{118}_1$. In the depicted embodiment, the pin 314 and the secondary button $\mathbf{110}_1$ are arranged such that counterclockwise rotation of the secondary button $\mathbf{110}_1$ will cause axial translation of the pin 314 and the slider 302 in the proximal direction and axial translation of the slider 302 and the pin 314 in the distal direction will cause clockwise rotation of the secondary button $\mathbf{110}_1$. A portion of the pin 316 is located in the path of rotation of the secondary button $\mathbf{110}_2$ in the counterclockwise direction above the biased pivot point $\mathbf{118}_2$. In the depicted embodiment, the pin 316 and the secondary button $\mathbf{110}_2$ are arranged such that counterclockwise rotation of the secondary button $\mathbf{110}_2$ will cause axial translation of the pin 316 and the slider 302 in the proximal direction and axial translation of the slider 302 and the pin 316 in the distal direction will cause clockwise rotation of the secondary button $\mathbf{110}_2$.

In FIG. 5A, the supply roll 200 is aligned with the shaft 102 of the mandrel, but the supply roll is not yet in contact with any portion of the mandrel 100. The primary button 108 and the secondary buttons 110 are biased in the counterclockwise direction by the pivot points 116, $\mathbf{118}_1$, and $\mathbf{118}_2$. The biasing of the primary button 108 and the secondary buttons 110 causes the primary button 108 and the secondary buttons 110 to rotate counterclockwise against the pins 312, 314, and 316 until the point depicted in FIG. 5A where the slider 302 has translated axially in the proximal direction as far as the slots 304 and 310 will permit the pins 306 and 308, respectively, to move. With the slider 302 unable to move further in the proximal direction, the pins 312, 314, and 316 prevent the primary button 108 and the secondary buttons 110 from rotating any further in the counterclockwise direction. In this position, the primary button 108 and the secondary buttons 110 are in their extended positions.

In FIG. 5B, the supply roll 200 has been moved in the axial direction to the point at which the core 202 has retracted the primary button 108. The retraction of the primary button 108 caused the primary button to rotate in the clockwise direction until it reached its retracted position, as shown in FIG. 5B. The clockwise rotation of the primary button 108 exerted a force on the pin 308, which caused the pin 308 and the slider 302 to translate axially in the distal direction. The axial translation of the slider 302 in the distal direction caused the pins 314 and 316 to exert a force in the distal direction on the secondary buttons 110 above the biased pivot points 118. The forces on the secondary buttons 110 from the pins 314 and 316 caused the secondary buttons to rotate clockwise until they reached their retracted positions, as shown in FIG. 5B. In this way, the retraction of the primary button 108 caused the retraction of the secondary buttons 110.

As the supply roll 200 is moved in the axial direction from the point shown in FIG. 5B, the core 202 will continue to hold all of the primary button 108 and the secondary buttons 110 in the retracted position so long as the core 202 contacts the primary button 108. The supply roll 200 can continue to be moved until the point shown in FIG. 5C where the core 202 is no longer in contact with the primary button 108. After the core 202 is no longer in contact with the primary button 108, the biased pivot point 116 causes the primary button 108 to rotate counterclockwise. The counterclockwise rotation of the primary button 108 exerts a force on the pin 312, which causes the pin 312 and the slider 302 to translate axially to in the proximal direction. The slider 302 continues to translate axially in the proximal direction as far as the slots 304 and 310 permit the pins 306 and 308, respectively, to move (e.g., to the position shown in FIG. 5B). At that point, the pin 312 prevents the primary button 108 from rotating any further in the counterclockwise direction, and the primary button 108 has returned to the extended position. The translation of the slider 302 in the proximal direction has caused separation of the pins 314 and 316 from the secondary buttons 110. However, the secondary buttons 110 have not rotated in the counterclockwise direction because the core 202 remains in contact with the secondary buttons 110.

In FIG. 5D, the supply roll 200 has been moved in the proximal direction until the core 202 is no longer in contact with the secondary button $\mathbf{110}_1$. After the core 202 is no longer in contact with the secondary button $\mathbf{110}_1$, the biased pivot point $\mathbf{118}_1$ causes the secondary button $\mathbf{110}_1$ to rotate counterclockwise. The secondary button $\mathbf{110}_1$ rotates counterclockwise until the position shown in FIG. 5D where the secondary button $\mathbf{110}_1$ is in contact with the pin 314 and the pin 314 prevents the secondary button $\mathbf{110}_1$ from rotating any further in the counterclockwise direction. At this point, the secondary button $\mathbf{110}_1$ has returned to the extended position. The secondary button $\mathbf{110}_2$ has not rotated in the counterclockwise direction because the core 202 remains in contact with the secondary button $\mathbf{110}_2$.

In FIG. 5E, the supply roll 200 has been moved in the proximal direction until the core is no longer in contact with the secondary button $\mathbf{110}_2$. After the core 202 is no longer in contact with the secondary button $\mathbf{110}_2$, the biased pivot point $\mathbf{118}_2$ causes the secondary button $\mathbf{110}_2$ to rotate counterclockwise. The secondary button $\mathbf{110}_2$ rotates counterclockwise until the position shown in FIG. 5E where the secondary button $\mathbf{110}_2$ is in contact with the pin 316 and the pin 316 prevents the secondary button $\mathbf{110}_2$ from rotating any further in the counterclockwise direction. At this point, the secondary button $\mathbf{110}_2$ has returned to the extended position. From this point, the film 204 can be unwound from the core 202 until the supply roll 200 is spent.

Figure 5F:
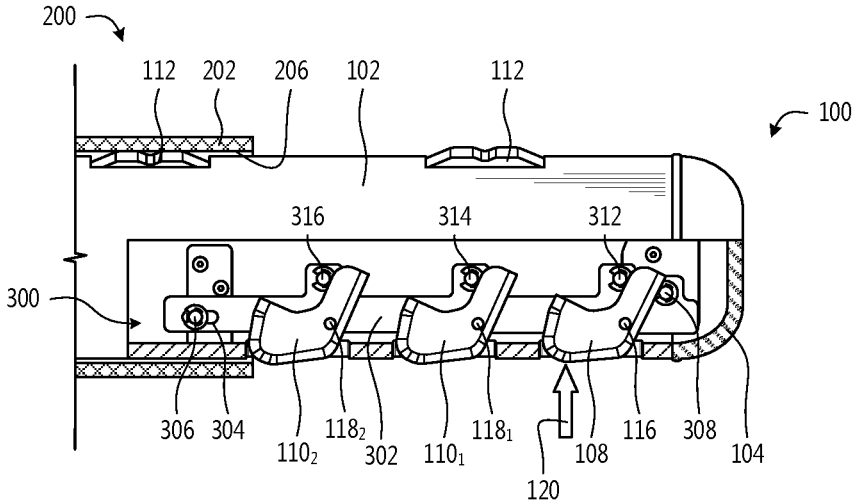

In FIG. 5F, the supply roll 200 is spent and the film 204 is no longer on the core 202. A user may want to remove the core 202 from the mandrel 100 and load a new supply roll on the mandrel 100. The user exerts the force 120 on the primary button 108 (e.g., by pressing the primary button 108 with the user's finger) to retract the primary button 108. The retraction of the primary button 108 by the force 120 caused the primary button 108 to rotate in the clockwise direction until it reached its retracted position, as shown in FIG. 5F. The clockwise rotation of the primary button 108 exerted a force on the pin 308, which caused the pin 308 and the slider 302 to translate axially in the distal direction. The axial translation of the slider 302 in the distal direction caused the pins 314 and 316 to exert a force in the distal direction on the secondary buttons 110 above the biased pivot points 118. The forces on the secondary buttons 110 from the pins 314 and 316 caused the secondary buttons to rotate clockwise until they reached their retracted positions, as shown in FIG. 5F. In this way, the retraction of the primary button 108 caused the retraction of the secondary buttons 110. At this point, the core 202 can be removed from the mandrel by moving the core 202 in the distal direction while the primary button 108 and the secondary buttons 110 are in the retracted positions.

As described, the embodiment of the retraction and extension system 300 provides the relationships among the primary button 108 and the secondary buttons 110 where retraction of the primary button 108 causes retraction of the secondary buttons 110, retraction of one of the secondary buttons 110 does not cause retraction of the primary button or any other of the secondary buttons, and extension of any one of the primary button 108 and the secondary buttons 110 does not cause extension of any other of the primary button 108 and the secondary buttons 110. It will be noted that the retraction and extension system 300 is not the only system that can provide these relationships among the primary button 108 and the secondary buttons 110. It will be apparent to one of ordinary skill in the art that other embodiments of retraction and extension system can provide these relationships among the primary button 108 and the secondary buttons 110.

For purposes of this disclosure, terminology such as "upper," "lower," "vertical," "horizontal," "inwardly," "outwardly," "inner," "outer," "front," "rear," and the like, should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Unless stated otherwise, the terms "substantially," "approximately," and the like are used to mean within 5% of a target value.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

What is claimed is:

1. A mandrel comprising:

a shaft configured to hold a supply roll of film;

a primary button located on the shaft; and one or more secondary buttons located on the shaft;

wherein the primary button and the one or more secondary buttons are biased toward an extended position and are capable of moving to a retracted position within the shaft; and wherein the primary button and the one or more secondary buttons are arranged on the shaft such that:

the primary button and the one or more secondary buttons retract to the retracted position during at least a portion of loading the supply roll of film onto the shaft, retraction of the primary button to the retracted position causes retraction of the one or more secondary buttons to the retracted position, retraction of one of the one or more secondary buttons to the retracted position does not cause retraction of the primary button, and when the supply roll of film is in an aligned position on the shaft, the supply roll of film is maintained in the aligned position in part by one of the primary button and the one or more secondary buttons in the extended position.

2. The mandrel of claim 1, wherein the primary button and the one or more secondary buttons are arranged on the shaft such that retraction of the one or more secondary buttons to the retracted position does not cause retraction of the primary button or any other of the one or more secondary buttons to the retracted position.

3. The mandrel of claim 1, wherein the primary button and the one or more secondary buttons are arranged on the shaft such that extension of any one of the primary button or the one or more secondary buttons to the extended position does not cause extension of any other one of the primary button or the one or more secondary buttons to the extended position.

4. The mandrel of claim 1, wherein the supply roll of film has a width that is one of a number of possible different widths.

5. The mandrel of claim 4, wherein the number of possible different widths is one more than the number of the one or more secondary buttons.

6. The mandrel of claim 1, wherein the one or more secondary buttons includes a plurality of secondary buttons.

7. The mandrel of claim 6, wherein the primary button and the plurality of secondary buttons are arranged axially along the shaft.

8. The mandrel of claim 1, wherein the primary button and the one or more secondary buttons are arranged on the shaft such unloading of the supply roll of film can be accomplished by applying a force to the primary button to retract the primary button and the one or more secondary buttons to the retracted position and sliding the supply roll of film off of the shaft while the primary button and the one or more secondary buttons are in the retracted position.

9. The mandrel of claim 1, wherein the shaft has a proximal end and a distal end, and wherein the loading of the supply roll of film onto the shaft is accomplished by sliding a core of the supply roll of film over the distal end of the mandrel and further sliding the supply roll of film toward the proximal end of the shaft.

10. The mandrel of claim 9, further comprising:

a collar coupled to the proximal end of the shaft.

11. The mandrel of claim 10, wherein, when the supply roll of film is in the aligned position on the shaft, the supply roll of film is between the collar and the one of the primary button and the one or more secondary buttons in the extended position.

12. The mandrel of claim 9, further comprising:

an end cap positioned on the distal end of the shaft, wherein the end cap is arranged to permit the supply roll of film to be slid onto the distal end of the shaft.

13. The mandrel of claim 1, further comprising:

a retraction and extension system configured to engage the primary button and to the one or more secondary buttons to cause the one or more secondary buttons to retract to the retracted position in response to the primary button being retracted to the retracted position.

14. A mandrel comprising:

a shaft configured to hold a supply roll of film;

a primary button located on the shaft; and one or more secondary buttons located on the shaft, wherein the primary button and the one or more secondary buttons are biased toward an extended position and are capable of moving to a retracted position; and wherein the primary button and the one or more secondary buttons are arranged on the shaft such that:

the primary button and the one or more secondary buttons retract to the retracted position during at least a portion of loading the supply roll of film onto the shaft, retraction of the primary button to the retracted position causes retraction of the one or more secondary buttons to the retracted position, and when the supply roll of film is in an aligned position on the shaft, the supply roll of film is maintained in the aligned position in part by one of the primary button and the one or more secondary buttons in the extended position;

wherein the mandrel further comprises a retraction and extension system configured to engage the primary button and to the one or more secondary buttons to cause the one or more secondary buttons to retract to the retracted position in response to the primary button being retracted to the retracted position;

wherein each of the primary button and the one or more secondary buttons is rotatable about a biased pivot point and is biased to the extended position by the biased pivot point.

15. The mandrel of claim 14, wherein the retraction and extension system comprises:

a slider configured to translate axially in a limited range inside of the shaft; and a plurality of pins fixedly coupled to the slider.

16. The mandrel of claim 15, wherein:

rotation of the primary button as the primary button is retracted from the extended position to the retracted position causes the primary button to exert a force on a first pin of the plurality of pins resulting in axial translation of the slider; and the axial translation of the slider causes one or more second pins of the plurality of pins to exert a force on the one or more secondary buttons resulting in the one or more secondary buttons retracting from the extended position to the retracted position.

17. A method of loading a supply roll of film onto a mandrel, wherein the mandrel is capable of holding supply rolls of different widths, the method comprising:

aligning the supply roll of film with a distal end of a shaft of the mandrel, wherein a width of the supply roll has is one of the different widths;

sliding the supply roll of film onto the shaft over the distal end of the shaft until the supply roll of film contacts a primary button on the shaft and retracts the primary button from an extended position to a retracted position within the shaft, wherein the mandrel is configured such that retraction of the primary button to the retracted position causes one or more secondary buttons on the shaft to be retracted from an extended position to a retracted position within the shaft and such that retraction of one of the one or more secondary buttons to the retracted position within the shaft does not cause retraction of the primary button; and further sliding the supply roll of film along the shaft until the supply roll of film reaches an aligned position on the shaft;

wherein, when the supply roll of film is in the aligned position:

the supply roll of film is not in contact with the primary button, the primary button is in the extended position, and the supply roll of film is maintained in the aligned position in part by one of the primary button and the one or more secondary buttons in the extended position.

18. The method of claim 17, wherein the primary button and the one or more secondary buttons are arranged axially along the shaft and the primary button is closer to the distal end than the one or more secondary buttons.

19. The method of claim 17, further comprising:

manually depressing the primary button while the supply roll of film is in the aligned position to cause the primary button to move from the extended position to the retracted position, wherein the mandrel is configured such that movement of the primary button to the retracted position caused by the manually depressing causes any of the one or more secondary buttons in the extended position to retract to the retracted position.

20. The method of claim 19, further comprising:

removing the supply roll of film from the shaft of the mandrel, wherein at least a portion of the removing occurs during a portion of the manually depressing of the primary button, and wherein the removing includes sliding the supply roll of film from the aligned position while the primary button is being manually depressed.

* * * * *